US005918667A

United States Patent [19]

Chiba et al.

[11] Patent Number: 5,918,667

[45] Date of Patent: Jul. 6, 1999

[54] HEAT EXCHANGER

[75] Inventors: Tomohiro Chiba, Isesaki; Hisao Aoki, Maebashi; Hirotaka Kado, Isesaki, all of Japan

[73] Assignee: Sanden Corporation, Gumma, Japan

[21] Appl. No.: 08/859,604

[22] Filed: May 20, 1997

Related U.S. Application Data

[60] Continuation of application No. 08/595,005, Jan. 31, 1996, abandoned, which is a division of application No. 08/285,162, Aug. 3, 1994, abandoned.

[30] Foreign Application Priority Data

Aug. 18, 1993 [JP] Japan ..... 5-226480

[51] Int. Cl.[6] ..... F28F 9/04

[52] U.S. Cl. ..... 165/178; 165/173

[58] Field of Search ..... 165/78, 153, 151, 165/173, 175, 178; 285/288.1

[56] References Cited

U.S. PATENT DOCUMENTS

| | | | |
|---|---|---|---|
| 1,666,076 | 4/1928 | Ufer | 285/288.1 X |
| 2,134,665 | 10/1938 | Karmazin | 165/174 X |
| 3,540,529 | 11/1970 | Umino . | |
| 4,034,802 | 7/1977 | Schwartz | 165/175 X |
| 4,429,738 | 2/1984 | Woodhull, Jr. | 165/151 |
| 4,586,566 | 5/1986 | Kern et al. | 165/173 |
| 4,657,069 | 4/1987 | Easton | 165/173 X |
| 4,663,812 | 5/1987 | Clausen . | |
| 4,749,033 | 6/1988 | Clausen | 165/173 |
| 5,046,555 | 9/1991 | Nguyen | 165/173 |
| 5,082,051 | 1/1992 | Ando . | |
| 5,211,221 | 5/1993 | Lease | 165/150 |
| 5,318,114 | 6/1994 | Sasaki . | |

FOREIGN PATENT DOCUMENTS

| | | | |
|---|---|---|---|
| 111926 | 8/1928 | Austria | 165/178 |
| 1117521 | 2/1982 | Canada | 165/173 |
| 37288 | 2/1990 | Japan | 165/153 |
| 651037 | 3/1951 | United Kingdom | 285/115 |
| 2166862 | 5/1986 | United Kingdom . | |

*Primary Examiner*—Leonard Leo
*Attorney, Agent, or Firm*—Baker & Botts, L.L.P.

[57] ABSTRACT

A heat exchanger includes reservoirs spaced apart from each other and a plurality of parallel heat transfer tubes fluidly connecting the reservoirs. An end portion of each heat transfer tube is connected to at least one of the reservoirs so that the end portion does not project into the interior of the reservoir. Thus, the dimension of the reservoir in the axial direction of the tubes and a proper volume of heat transfer medium may be minimized. Further, pressure loss can be reduced because there are no projecting tubes in the reservoirs to obstruct the flow of the heat transfer medium. Moreover, the strength of the connection between the tubes and the reservoirs can be increased because more contacting surface area is provided for making the connection, for example by brazing.

6 Claims, 6 Drawing Sheets

HEAT EXCHANGER

CROSS REFERENCE TO RELATED APPLICATIONS

This application is a continuation of U.S. application Ser. No. 08/595,005, entitled "Heat Exchanger", and filed Jan. 31, 1996 by Tomohiro Chiba, now abandoned, which is a divisional of U.S. application Ser. No. 08/285,162, entitled "Heat Exchanger" and filed Aug. 3, 1994 by Tomohiro Chiba et al, now abandoned.

BACKGROUND OF THE INVENTION

1. Field of the Invention

The present invention relates to a heat exchanger suitable for use in a vehicle air conditioning system and, more particularly, to a structure for connecting heat transfer tubes to heat exchanger reservoirs.

2. Description of the Related Art

FIG. 8 depicts a conventional heat exchanger for use in a vehicle air conditioning system. A heat exchanger 61 comprises an upper reservoir 62 and a lower reservoir 63. A plurality of heat transfer tubes 64 are fluidly connected between upper and lower reservoirs 62 and 63. A heat transfer medium, for example refrigerant, flows from an inlet pipe 65 to an outlet pipe 66. Generally, the heat transfer medium flows through the interior of upper reservoir 62, down heat transfer tubes 64, through the interior of lower reservoir 63, up heat transfer tubes 64, and through the interior of upper reservoir 62, thereafter exiting from outlet pipe 66. The heat transfer medium flowing through tubes 64 exchanges heat with outside air passing between tubes 64.

In a conventional heat exchanger, heat transfer tubes 64 are typically connected to upper and lower reservoirs 62 and 63, for example, in such a manner as shown in FIG. 9. In FIG. 9, an end portion 67 of heat transfer tube 64 is inserted into an interior of upper reservoir 62 through hole 68 formed in the reservoir wall. The periphery of end portion 67 is connected to the surface of hole 68. This connection is typically achieved by brazing. End portion 67 of heat transfer tube 64 projects into the interior of reservoir 62 to a projection length B. Heat transfer tubes 64 are typically connected to lower reservoir 63 in the same manner.

Because end portion 67 of each heat transfer tube 64 projects into the interior of reservoir 62, a dimension A of reservoir 62 in the longitudinal direction of tubes 64 must be designed taking into account projection length B. As projection length B increases, dimension A also increases, thereby increasing the size of upper reservoir 62. Thus, the total size of heat exchanger 61 also increases. As the size of reservoirs 62 and 63 increases, the proper volume of heat transfer medium to be circulated in heat exchanger 61 also increases. Regardless of the care taken in designing heat exchanger 61, minimization of the size of reservoirs 62 and 63 is limited by the projection of end portions 67.

Another disadvantage of the conventional heat exchanger is that the flow of a heat transfer medium in reservoirs 62 and 63 is obstructed by end portions 67 projecting into reservoirs 62 and 63. This obstruction of flow typically causes a pressure loss in the flow circuit of the heat transfer medium.

Another disadvantage is that the surface area for brazing heat transfer tubes 64 to reservoirs 62 and 63 is typically small. Thus, the strength of the connections therebetween might be insufficient. This presents particular problems, for example, when heat exchanger 61 is disposed in a vehicle engine compartment where it is subjected to extended periods of vibration. In such a situation, it is often difficult to ensure sufficient reliability of the strength of the connections between tubes 61 and reservoirs 62 and 63.

SUMMARY OF THE INVENTION

It is an object of the present invention to provide a heat exchanger with a structure for connecting heat transfer tubes to heat exchanger reservoirs which will minimize the necessary size of the reservoirs, thereby minimizing the overall size of the heat exchanger. This structure should also decrease a proper volume of heat transfer medium to be circulated and should minimize pressure loss in the flow circuit of the heat exchanger.

It is another object of the present invention to provide a heat exchanger with a structure for connecting heat transfer tubes to heat exchanger reservoirs which will ensure a sufficient strength in the connections between the heat transfer tubes and the reservoirs.

It is yet another object of the present invention to provide a heat exchanger with a structure which increases the surface area available for brazing in the connection of heat transfer tubes to heat exchanger reservoirs.

To achieve these and other objects, the present invention provides a heat exchanger with two or more reservoirs spaced apart from each other and a plurality of heat transfer tubes fluidly connecting the reservoirs. An end portion of at least one heat transfer tube is connected to at least one of the reservoirs so that the end portion does not project into the interior of the reservoir.

According to the present invention, a side wall of the reservoir may be deformed to have at least one tubular portion extending therefrom. An end portion of a heat transfer tube is connected to the tubular portion. This connection may be made, for example, by brazing. The tubular portion and the end portion may have a variety of alternate shapes according to various embodiments.

According to one embodiment, the tubular portion extends outwardly from the side wall along an axial direction of the heat transfer tubes. The tubular portion has a first portion with a first diameter and is integral with the side wall. A second portion has a second diameter larger than the first diameter. A third portion is integral with and joins the first and second portions. The end portion is inserted into the second portion such that an end surface of the end portion abuts the third portion.

According to another embodiment, the tubular portion is tapered to have an increasing diameter as extends from the side wall. The end portion is tapered to have a decreasing diameter toward an end surface thereof. The end portion is inserted into the tubular portion.

According to another embodiment, the tubular portion is cylindrical and has a diameter smaller than a diameter of the end portion. The end portion is fitted onto a periphery of the tubular portion such that an end surface of the end portion abuts an outer surface of the side wall.

In another embodiment, the tubular portion is cylindrical. The end portion has a diameter larger than the diameter of a central portion of the heat transfer tube. The end portion is fitted onto the periphery of the portion. An integral stepped portion may be provided to join the end portion and central portion of the heat transfer tube. Also, an end surface of the tubular portion may abut the stepped portion.

In yet another embodiment, the tubular portion is tapered to have a decreasing diameter as it extends from the side wall. The end portion is inserted into the tubular portion and is tapered so that an outer surface of the end portion contacts an inner surface of the tubular portion. The end portion may be tapered, for example, by a jig. This embodiment may be modified by tapering the end portion to fit onto a periphery of the tapered tubular portion.

A technical advantage of the present invention is that it is not necessary to provide space in the reservoir for a projection of the heat transfer tube. Therefore, the size of the reservoir in the axial direction of the heat transfer tube can be minimized. Moreover, the total size of the heat exchanger can be minimized. Further, a smaller volume of heat transfer medium can be circulated in the heat exchanger.

Another technical advantage of the present invention is that the flow of the heat transfer medium in the reservoir is not obstructed by projections of heat transfer tubes. Therefore, the heat transfer medium can flow smoothly in the interior of the reservoir, and can flow more smoothly between the tubes and the the interior of the reservoir. As a result, pressure loss of the flow of the heat transfer medium in the heat exchanger can be minimized.

Still another technical advantage of the present invention is that the area for connection, for example by brazing, between the heat transfer tube and the reservoir can be increased by providing a tubular portion extending outwardly from the side wall and connecting the end portion of the heat transfer tube to the tubular portion. As a result of increased contacting surface area, the strength of the connection therebetween can be greatly increased.

Further objects, features, and advantages of the present invention will be understood from the detailed description of the preferred embodiments of the present invention with reference to the appropriate figures.

DETAILED DESCRIPTION OF THE PREFERRED EMBODIMENTS

Figure 1:
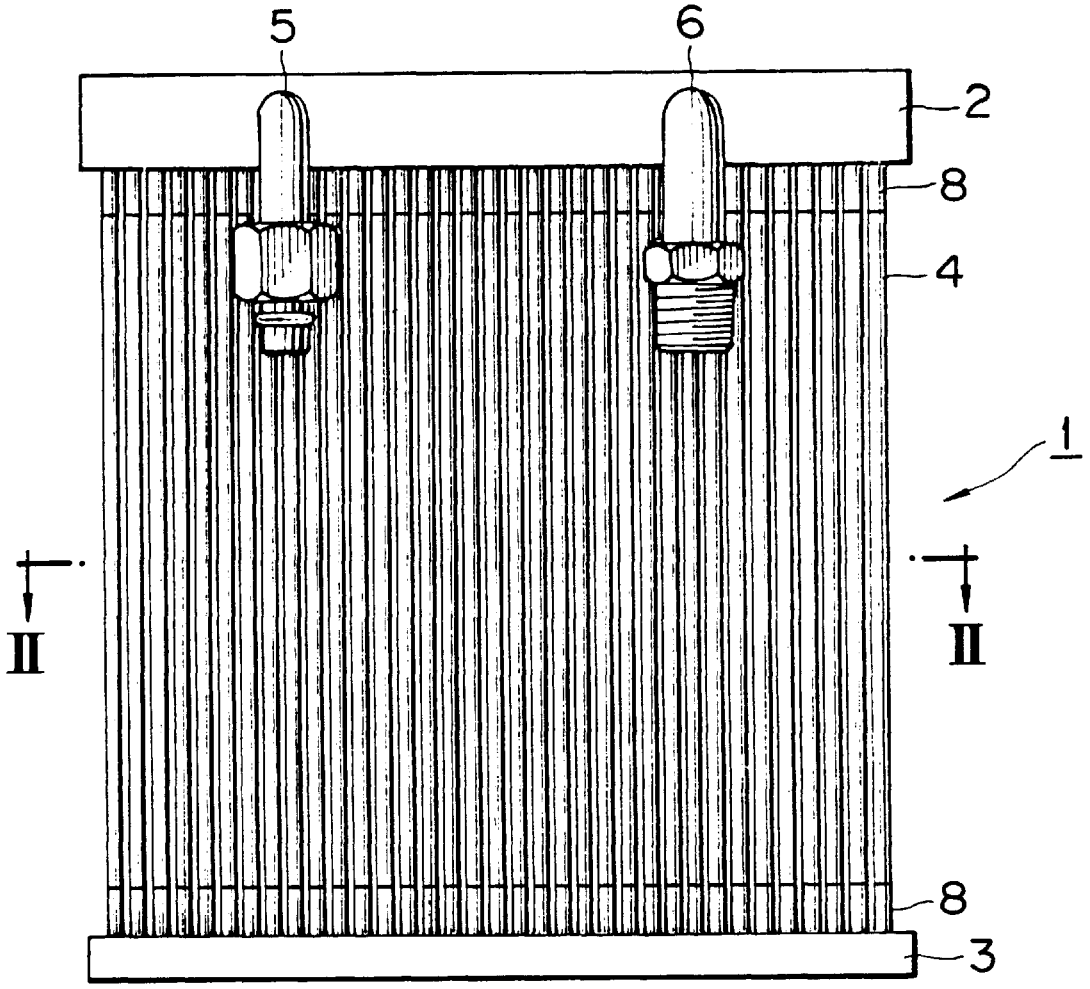
FIG. 1 is an elevational view of a heat exchanger according to a first embodiment of the present invention.
Figure 2:
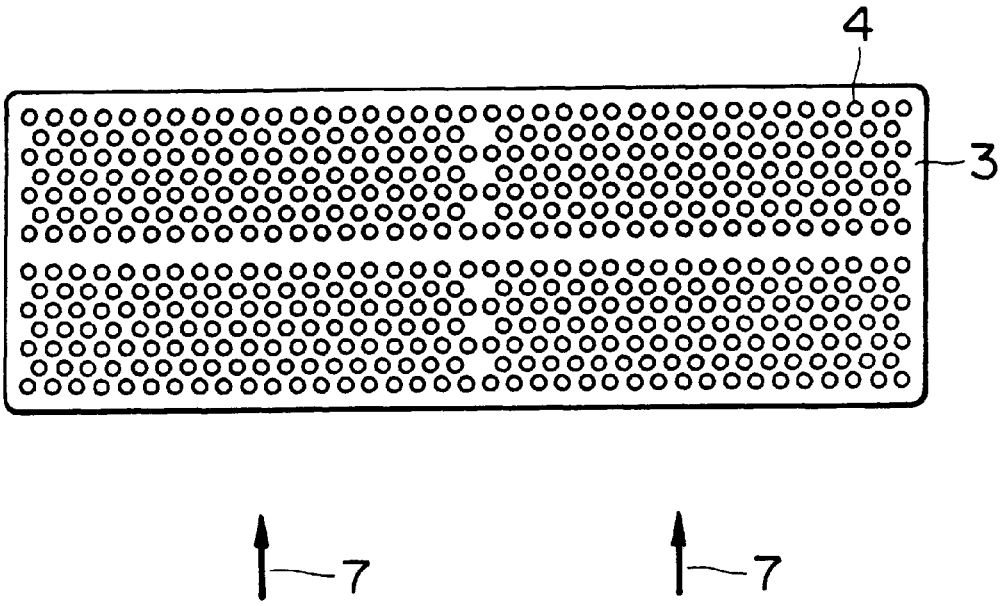
FIG. 2 is a cross-sectional view of the heat exchanger depicted in FIG. 1, taken along II—II line of FIG. 1.
Figure 3:
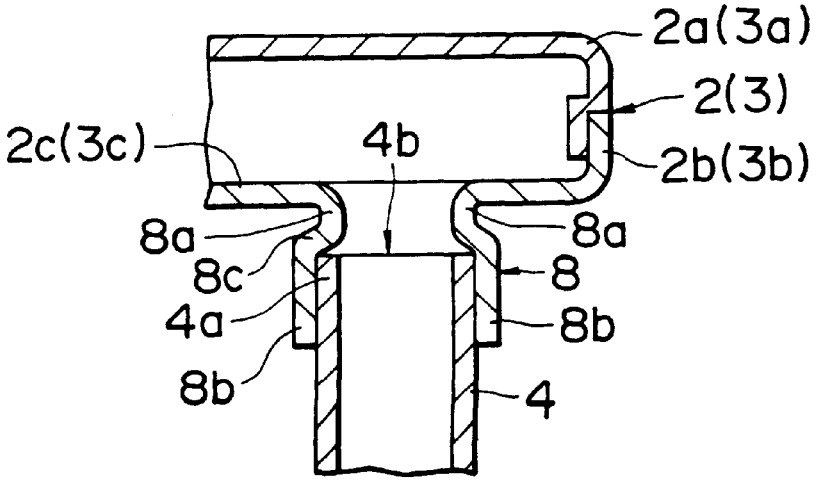
FIG. 3 is an enlarged, partial, cross-sectional view of the heat exchanger depicted in FIG. 1.

Referring to FIGS. 1–3, a heat exchanger 1 is provided according to a first embodiment of the present invention. Heat exchanger 1 includes reservoirs 2 and 3. Reservoir 2 is an upper tank and reservoir 3 is a lower tank in this embodiment. A plurality of parallel heat transfer tubes 4 fluidly connect reservoirs 2 and 3. Inlet pipe 5 and outlet pipe 6 are connected to reservoir 2. A heat transfer medium, for example a refrigerant, flows through heat exchanger 1 from inlet pipe 5 to outlet pipe 6. The preferred flow circuit of the refrigerant is from inlet pipe 5, through the interior of reservoir 2, down heat transfer tubes 4, through the interior of reservoir 3, up heat transfer tubes 4, through the interior of reservoir 2 and through outlet pipe 6. As the heat transfer medium flows through tubes 4, heat is exchanged between the heat transfer medium and the atmosphere or an air flow 7 (shown in FIG. 2) passing between tubes 4. This heat exchange takes place through the walls of tubes 4.

Reservoir 2 is preferably constructed from two members 2*a* and 2*b* fitted and connected to each other as shown in FIG. 3. The connection may be made, for example, by brazing. Member 2*b* has a side wall 2*c* which, together with member 2*a*, defines an interior of reservoir 2. Side wall 2*c* is deformed to create a plurality of tubular portions 8 which are preferably positioned at an end portion 4*a* of each heat transfer tube 4. Tubular portion 8 extends outwardly from side wall 2*c* and away from the interior of reservoir 2 along an axial direction of each heat transfer tube 4.

In this embodiment, tubular portion 8 is formed as a stepped portion and includes a first portion 8*a* having a first diameter and integrally connected to side wall 2*c*. A second portion 8*b* having a second diameter larger than said first diameter. Second portion 8*b* is preferably spaced apart from and coaxial with first portion 8*a*. A third portion 8*c* joins first portion 8*a* and second portion 8*b*. Third portion 8*c* is preferably a stepped portion integral with and coaxial with first and second portions 8*a* and 8*b*. End portion 4*a* of each heat transfer tube 4 is inserted into and fitted to second portion 8*b* of a corresponding tubular portion 8, such that end surface 4*b* of the end portion 4*a* abuts third portion 8*c*.

Reservoir 2 and heat transfer tubes 4 are preferably made from an aluminum or an aluminum alloy. Preferably, either reservoir 2 or tubes 4 are clad with a brazing material, and end portions 4*a* and tubular portions 8 are brazed to each other. Connections between heat transfer tubes 4 and reservoir 3 are preferably established in a manner similar to that described above.

End portions 4*a* of each heat transfer tube 4 are inserted into second portions 8*b* of corresponding tubular portions 8 formed on respective side walls 2*c* and 3*c*. End portions 4*a* are preferably brazed to tubular portions 8. Since end portions 4*a* of each heat transfer tube 4 do not project into the interiors of reservoirs 2 and 3, the dimensions of reservoirs 2 and 3 in the axial direction of the tubes 4 can be minimized. The capacities of reservoirs 2 and 3 can thus be decreased by minimizing the overall sizes of the reservoirs 2 and 3. A proper volume of a heat transfer medium to be circulated in the heat exchanger can thereby be minimized.

Further, since end portions 4*a* of each heat transfer tube 4 do not project into the interiors of reservoirs 2 and 3, the flow of the heat transfer medium in reservoirs 2 and 3 is not obstructed by end portions 4*a*. Therefore, the heat transfer medium can smoothly flow within reservoirs 2 and 3 and can smoothly flow between tubes 4 and the interiors of reservoirs 2 and 3. As a result, a pressure loss in the flow of the heat transfer medium in the flow circuit of the heat exchanger can be greatly reduced.

Also, the above-described structure provides a larger connection area between heat transfer tubes 4 and reservoirs 2 and 3 than that provided by conventional heat exchangers. Therefore, the strength of the connection between heat transfer tubes 4 and reservoirs 2 and 3 is increased over the prior art.

Thus, even if heat exchanger 1 is exposed to a relatively large and/or substantially continuous vibration, the connections will not be broken.

Further, since end surfaces 4*b* of end portions 4*a* of heat transfer tubes 4 abut third portions 8*c* of tubular portions 8, alignment between tubes 4 and reservoirs 2 and 3 can be easily and precisely established.

Figure 4:
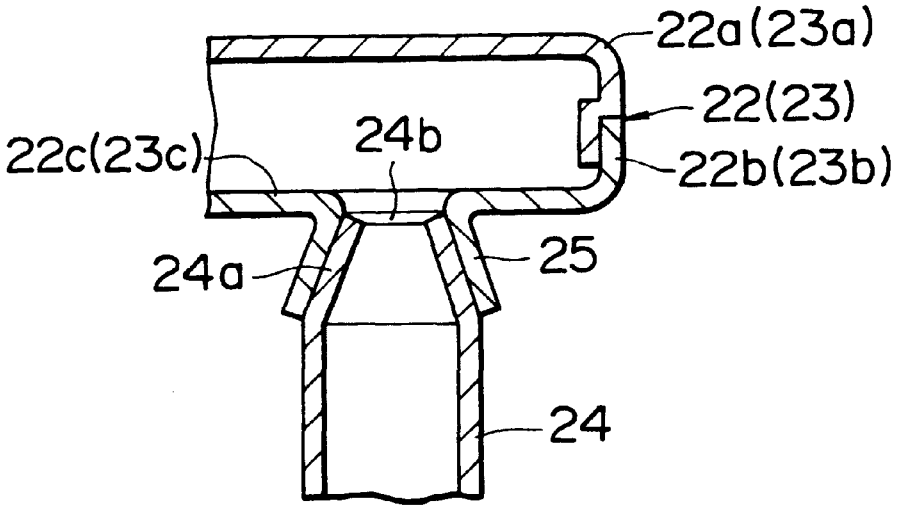
FIG. 4 is an enlarged, partial, cross-sectional view of a heat exchanger according to a second embodiment of the present invention.

FIG. 4 depicts the structure of the connection between heat transfer tubes 24 and reservoirs 22 or 23 according to a second embodiment of the present invention. Similar to the previous embodiment, reservoir 22 preferably comprises two members 22*a* and 22*b*, and reservoir 23 preferably comprises two members 23*a* and 23*b*. Tubular portion 25 is created by deforming side walls 22*c* and 23*c* of the respective reservoirs 22 and 23. In this embodiment, tubular portion 25 is tapered to have an increasing diameter as it extends from side wall 22*c* or 23*c*. End portion 24*a* of each heat transfer tube 24 is tapered to have a diameter that decreases toward end surface 24*b* of end portion 24*a*. Tubular portion 25 and end portion 24*a* preferably have substantially the same degree of tapering. Each tapered end portion 24*a* is inserted into a corresponding tapered tubular portion 25, such that end portion 24*a* is fitted to tubular portion 25. Preferably, end portion 24*a* is then brazed and fixed to the corresponding tubular portion 25.

In such a structure, substantially the same advantages as those described in connection with the first embodiment can be obtained. Moreover, in this embodiment, since tubular portion 25 and end portion 24*a* are both tapered, fitting therebetween can be easily performed.

Figure 5:
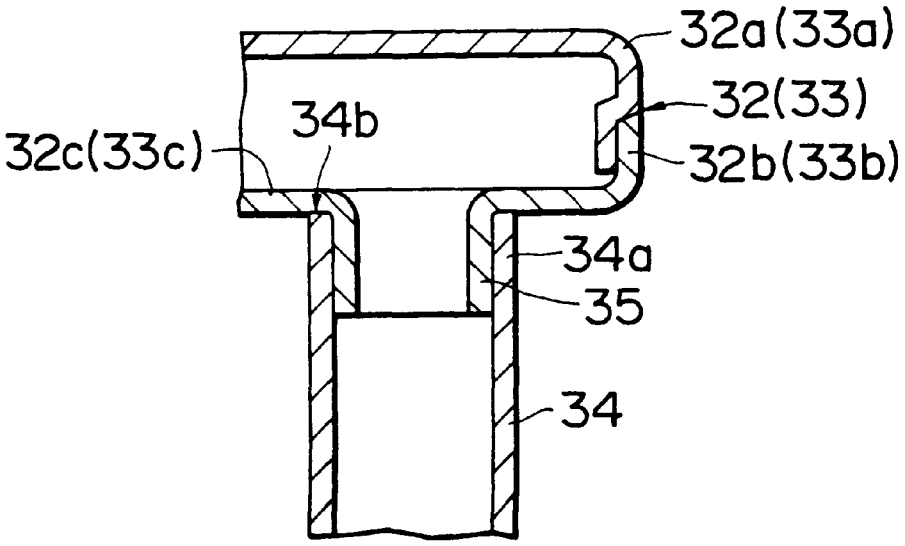
FIG. 5 is an enlarged, partial, cross-sectional view of a heat exchanger according to a third embodiment of the present invention.

FIG. 5 depicts the structure of the connection between heat transfer tubes 34 and reservoirs 32 or 33 according to a third embodiment of the present invention. Similar to the previous embodiment, reservoir 32 preferably comprises two members 32*a* and 32*b*, and reservoir 33 preferably comprises two members 33*a* and 33*b*. Tubular portion 35 is created by deforming side walls 32*c* and 33*c* of the respective reservoirs 32 and 33. In this embodiment, tubular portions 35 are preferably cylindrical and have diameters smaller than the diameters of end portions 34*a* of heat transfer tubes 34. End portion 34*a* of each heat transfer tube 34 is fitted onto the periphery of a corresponding tubular portion 35. End surface 34*b* of end portion 34*a* abuts an outer surface of side wall 32*c* or 33*c* of the respective reservoir 32 or 33. End portion 34*a* is preferably brazed and fixed to the corresponding tubular portion 35.

In such a structure, substantially the same advantages as those described in connection with the first embodiment can be obtained. Moreover, in this embodiment, it is not necessary to process end portions 34*a* of heat transfer tubes 34.

Figure 6:
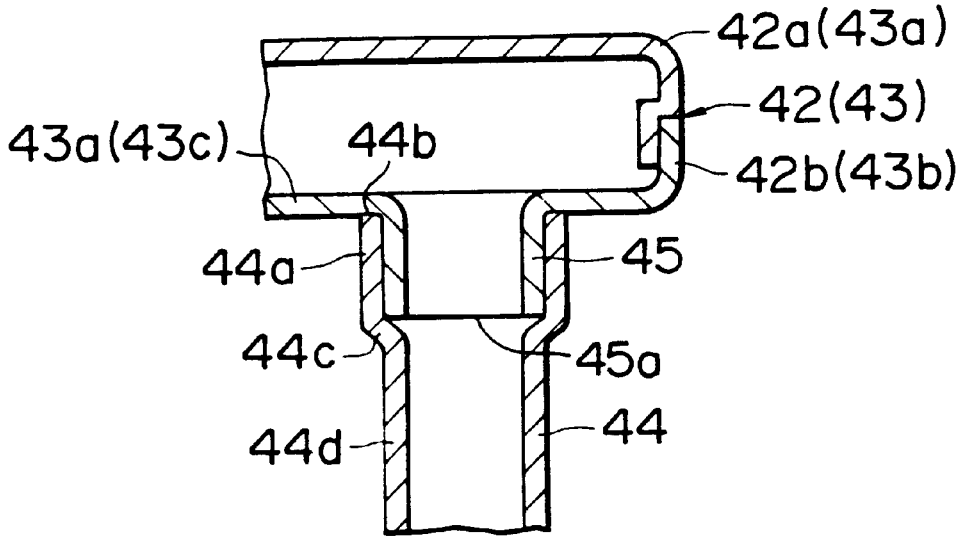
FIG. 6 is an enlarged, partial, cross-sectional view of a heat exchanger according to a fourth embodiment of the present invention.

FIG. 6 depicts the structure of the connection between heat transfer tubes 44 and reservoirs 42 or 43 according to a fourth embodiment of the present invention. Similar to the previous embodiment, reservoir 42 preferably comprises two members 42*a* and 42*b*, and reservoir 43 preferably comprises two members 43*a* and 43*b*. Tubular portion 45 is created by deforming side walls 42*c* and 43*c* of the respective reservoirs 42 and 43. In this embodiment, end portion 44*a* of each heat transfer tube 44 has a diameter larger than the diameter of a central portion 44*d* of tube 44. End portion 44*a* is preferably fitted onto the periphery of a corresponding tubular portion 45. A stepped portion 44*c* is provided to join end portion 44*a* and central portion 44*d* of tube 44. Stepped portion 44*c* is preferably integral with and coaxial with end portion 44*a* and central portion 44*d*. End surface 44*b* of end portion 44*a* abuts an outer surface of side wall 42*c* or 43*c* of the respective reservoir 42 or 43. Also, end surface 45*a* of a corresponding tubular portion 45 preferably abuts stepped portion 44*c*. End portion 44*a* is preferably brazed and fixed to the corresponding tubular portion 45.

In such a structure, substantially the same advantages as those described in connection with the first embodiment can be obtained. Moreover, in this embodiment, the inner diameter of tubular portion 45 can be designed to be substantially the same as the inner diameter of heat transfer tube 44 (more precisely, the inner diameter of central portion 44*d*). Therefore, the heat transfer medium can flow smoothly in tube 44 and between tube 44 and reservoirs 42 and 43.

Figure 7:
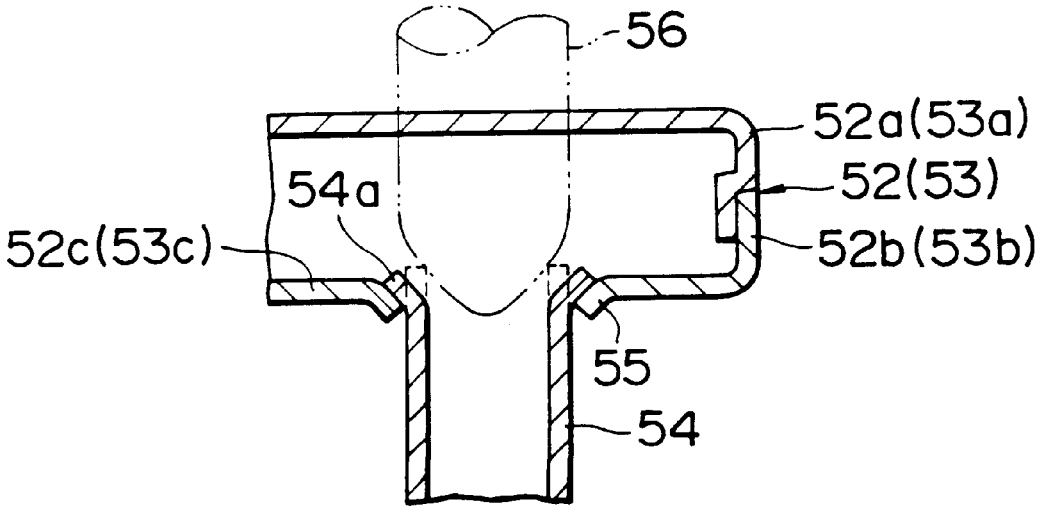
FIG. 7 is an enlarged, partial, cross-sectional view of a heat exchanger according to a fifth embodiment of the present invention.
Figure 8:
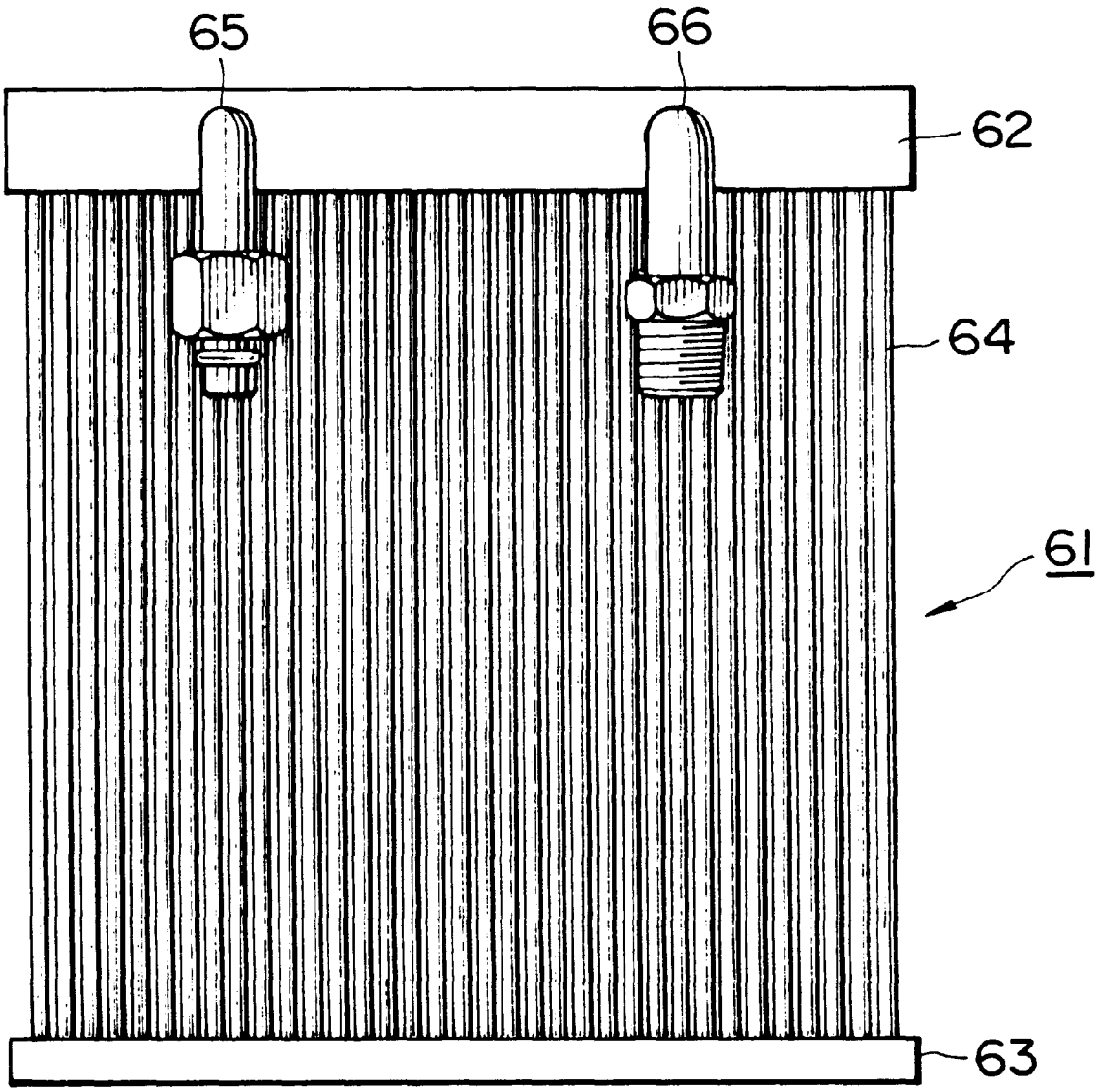
FIG. 8 PRIOR ART
FIG. 8 is an elevational view of a heat exchanger according to the prior art.
Figure 9:
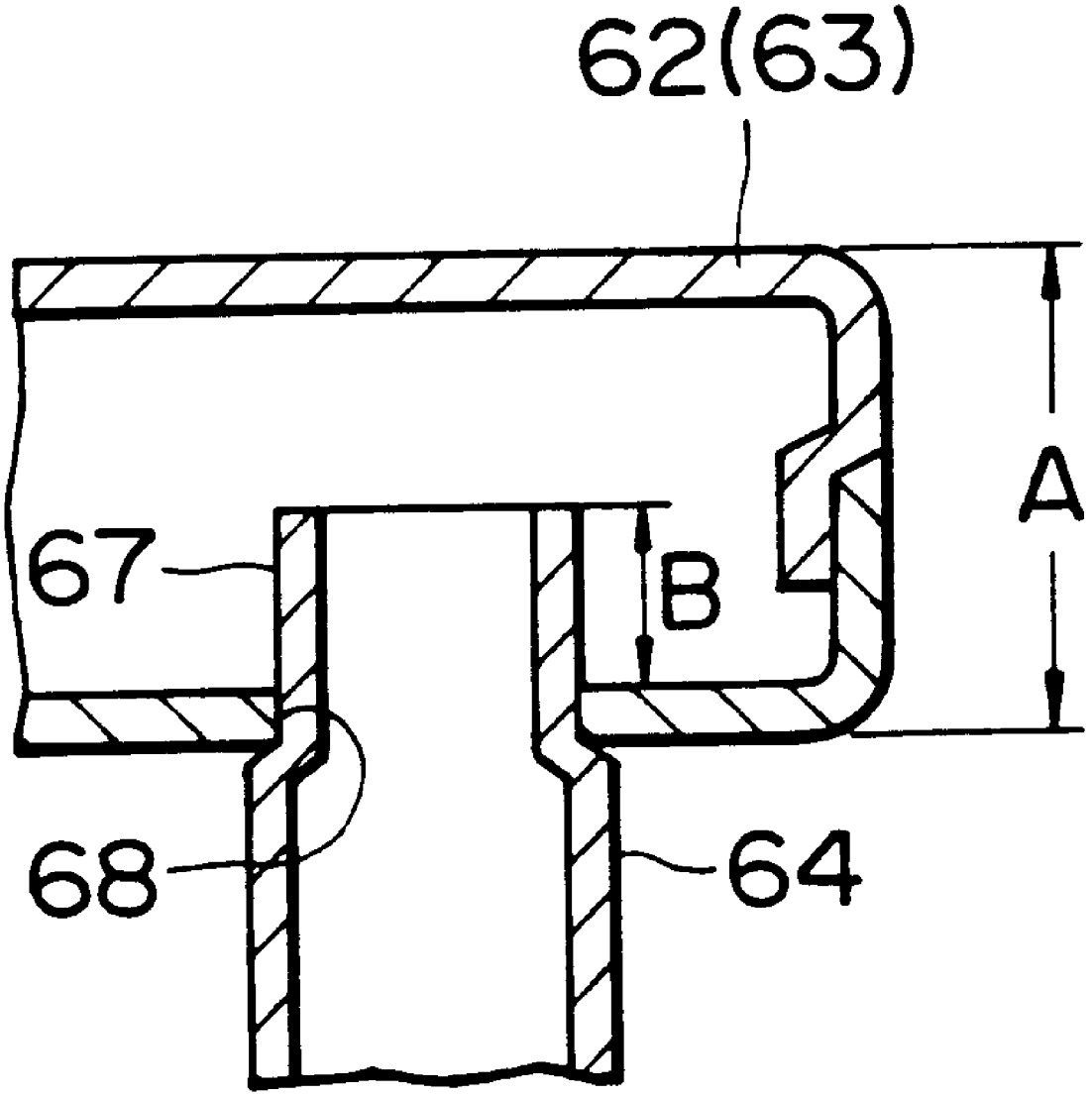
FIG. 9 PRIOR ART
FIG. 9 is an enlarged, partial, cross-sectional view of the heat exchanger depicted in FIG. 8.

FIG. 7 depicts the structure of the connection between heat transfer tubes 54 and reservoirs 52 or 53 according to a fifth embodiment of the present invention. Similar to the previous embodiment, reservoir 52 preferably comprises two members 52*a* and 52*b*, and reservoir 53 preferably comprises two members 53*a* and 53*b*. In this embodiment, tubular portion 55 is tapered to have a decreasing diameter as it extends from side wall 52*c* or 53*c* of reservoir 52 or 53. As shown in FIG. 7 each tubular portion 55 preferably has a smaller length in the axial direction of heat transfer tube 54 as compared with the lengths of the tubular portions in the previous embodiments. End portion 54*a* of each heat transfer tube 54 is inserted into a corresponding tubular portion 55. The inserted end portion 54*a* is then tapered to fit the inner surface of tapered tubular portion 55. According to this structure, an outer surface of end portion 54*a* should contact an inner surface of tubular portion 55. End portion 54*a* may be tapered by being deformed by a jig 56. This deformation by jig 56 is preferably performed before members 52*a* and 52*b* or 53*a* and 53*b* are connected to each other. Deformed end portion 54*a* is preferably brazed and fixed to the corresponding tubular portion 55.

In such a structure, substantially the same advantages as those in the first embodiment can be obtained. Moreover, in this embodiment, deformation of tubular portion 55 and end portion 54*a* can be easily performed.

Although the heat transfer tubes do not project into either the upper or lower reservoirs in the embodiments described above, the advantages according to the present invention can be achieved even if the heat transfer tubes project into only one of the reservoirs. Further, although it is intended that the heat transfer tubes do not project into the interiors of the reservoirs, the structures of the present invention can be used to reduce the amount of projection. Thus, even if the heat transfer tubes only slightly project into the interiors, the present invention will still provide advantages over conventional heat exchangers.

Although several preferred embodiments of the present invention have been described in detail herein, the invention is not limited thereto. It will be appreciated by those having ordinary skill in the art that various modifications may be made without materially departing from the novel and advantageous teachings of the invention. For example, the teachings of the present invention can be incorporated into a heat exchanger having any number of reservoirs. Accordingly, the embodiments disclosed herein are by way of example. It is to be understood that the scope of the invention is not to be limited thereby, but is to be determined by the claims which follow.

What is claimed is:

1. A heat exchanger comprising:

two or more reservoirs spaced vertically apart from each other, each of said reservoirs having an interior; and a plurality of heat transfer tubes each having a wall with a uniform thickness over an entire length thereof, said tubes fluidly connecting said reservoirs, each of said plurality of heat transfer tubes having a first end portion connected to a first one of said reservoirs and a second end portion connected to a second one of said reservoirs so that said first and second end portions do not project into the interior of reservoirs, and a central portion connecting said first and second end portions, the central portion having a constant diameter, each of said reservoirs comprising a side wall a tubular portion integral with and extending outwardly from said side wall along an axial direction of said plurality of heat transfer tubes, each of said tubular portions being tapered and extending from said side wall with an increasing diameter, each of said first and second end portions being tapered with a diameter that decreases at a constant rate from the diameter of said central portion to a smaller diameter at the end surface of said end portion, each of said first and second end portions being coextensive with said side wall.

2. The heat exchanger of claim 1, wherein each of said end portions is connected to said reservoirs by brazing.

3. The heat exchanger of claim 1 wherein each of said tubular portions at least partially surrounds a corresponding end portion.

4. The heat exchanger of claim 1, wherein said reservoirs receive therein a refrigerant comprising a combination of liquid and gaseous phases, and wherein said end portions do not project into the interior of said at least one of said reservoirs, the liquid phase of the refrigerant flowing uniformly from said reservoirs into the plurality of heat transfer tubes.

5. A heat exchanger comprising:

a first reservoir;

a second reservoir spaced from the first reservoir; and at least one heat transfer tube having a wall with a uniform thickness over an entire length thereof, said tube having first and second tapered end portions, each tapered end portion having a diameter that decreases at a constant rate from the diameter of said central portion to a smaller diameter at an end surface thereof, each of the first and second reservoirs comprising a side wall and at least one tapered tubular portion integral with and extending outwardly from the side wall with an increasing diameter, the first tapered end portion being inserted into the at least one tapered tubular portion of the first reservoir, the second tapered end portion being inserted into the at least one tapered tubular portion of the second reservoir.

6. A heat exchanger comprising:

two or more reservoirs spaced vertically apart from each other, at least one of said reservoirs comprising a side wall defining an interior, and at least one tubular portion extending outwardly from said side wall; and a plurality of heat transfer tubes each having a wall with a uniform thickness over an entire length thereof, said tubes fluidly connecting said reservoirs, each of said plurality of heat transfer tubes having a central portion with a constant diameter and an end portion inserted into said at least one tubular portion so that said end portion does not project into the interior of said at least one of said reservoirs, said end portion being coextensive with said side wall, said end portion having a diameter that decreases at a constant rate from the diameter of said central portion to a smaller diameter at an end surface of said end portion.

* * * * *